United States Patent [19]

Woodward et al.

[11] 4,333,205

[45] Jun. 8, 1982

[54] VACUUM CLEANER WITH SOIL AGITATOR AND COMPRESSED AIR MEANS

[75] Inventors: James C. Woodward, Elizabethtown; Marion D. Holland, Cox's Creek, both of Ky.

[73] Assignee: Robert E. Robbins, Elizabethtown, Ky.

[21] Appl. No.: 94,354

[22] Filed: Nov. 14, 1979

[51] Int. Cl.[3] ..... A47L 5/14

[52] U.S. Cl. ..... 15/345; 15/383; 15/397; 15/402; 15/415 R

[58] Field of Search ..... 15/345, 346, 383, 384, 15/388, 397, 402, 415 R, 416

[56] References Cited

U.S. PATENT DOCUMENTS

| | | | |
|---|---|---|---|
| 2,524,117 | 10/1950 | Storm | 15/346 X |
| 3,268,942 | 8/1966 | Rossnan | 15/346 |
| 3,694,848 | 10/1972 | Alcala | 15/346 |

FOREIGN PATENT DOCUMENTS

| | | | |
|---|---|---|---|
| 167076 | 2/1956 | Australia | 15/345 |
| 977910 | 11/1975 | Canada | 15/346 |

*Primary Examiner*—Chris K. Moore

*Attorney, Agent, or Firm*—Richard L. Caslin

[57] ABSTRACT

A vacuum cleaning machine using a floor-mounted vacuum hood forming a travelling vacuum chamber with an optimum combination of suction nozzle intake means, jet stream manifold means and a mechanical soil agitator means in the form of a carpet rake, where the rake is interposed between the suction nozzle intake means and a plurality of jet streams. The jet streams are generally directed toward the tips of the teeth of the carpet rake and from there toward the intake opening of the suction nozzle means to increase the effectiveness of the suction nozzle means. A second modification of the invention shows the carpet rake replaced by a power-driven brush, and the jet stream means is a combined carpet rake and source of a plurality of jet streams directed toward the working area of the brush. An optimum design is where the compressed air that divides into a plurality of jet streams is made to pulsate so as to create a hammering action on the soil.

6 Claims, 5 Drawing Figures

FIG. 4
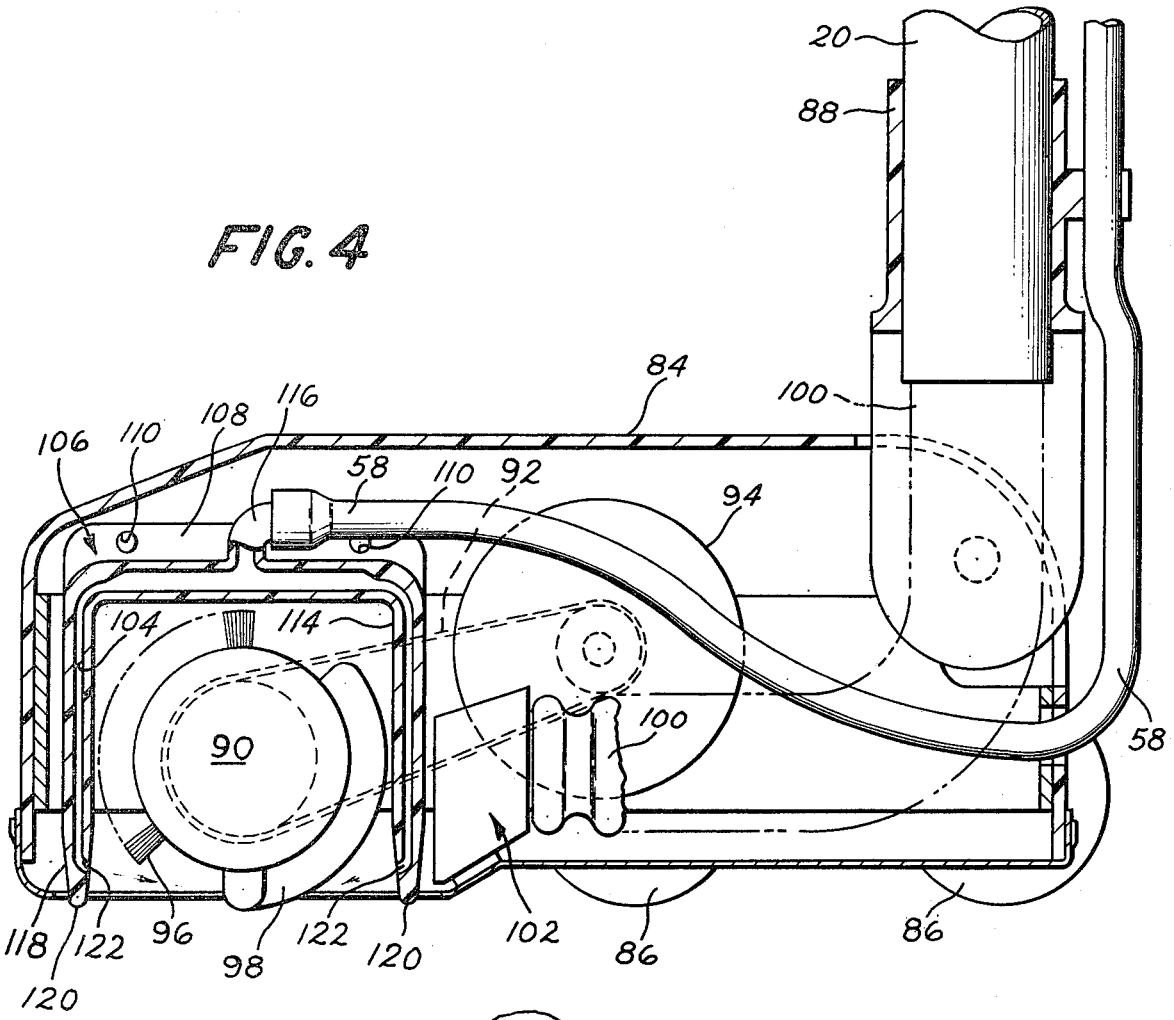
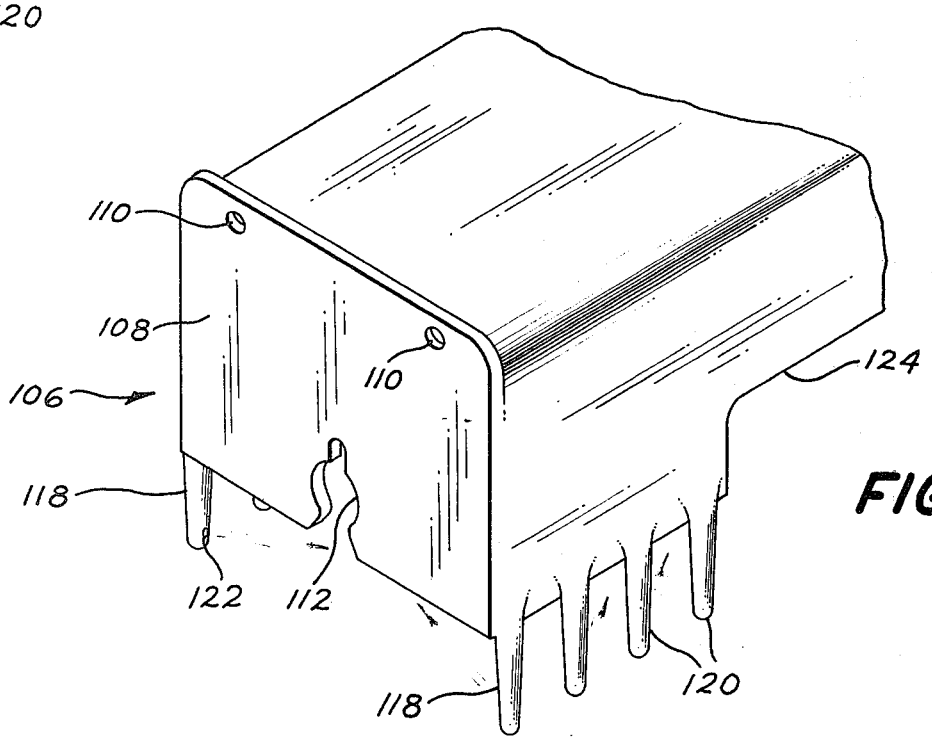
FIG. 5

VACUUM CLEANER WITH SOIL AGITATOR AND COMPRESSED AIR MEANS

BACKGROUND OF THE INVENTION

1. Field of the Invention

This invention relates to vacuum cleaners for household or industrial use for removing foreign matter, dust and debris from floor or carpet surfaces, and particularly those cleaners which provide compressed air means for dislodging or agitating the soil and conveying it toward the vacuum intake means.

2. Description of the Prior Art

An early patent in this art is Farnsworth U.S. Pat. No. 1,281,925 which describes a vacuum cleaner with an inlet opening and a suction-creating, motor/blower wheel or fan that conveys the soil-laden air from the floor or carpet to a porous cleaner bag or filter bag. A second porous cleaner bag or filter bag surrounds the first bag, and part of the air in the second bag is returned to the vicinity of the inlet opening where a blast of air is directed down into the inlet opening to dislodge or agitate the soil on the floor or in the carpet. Thus a partial air recirculating system is provided.

The Hornschuch et al. U.S. Pat. No. 3,161,900 describes a vacuum cleaning head for use with mining apparatus around mine shafts and drilling sites. The head is equipped with a high pressure air blast which is operable to impart a velocity to objects heavier than dust so that they may be collected by an integral vacuum device.

The Lake et al. U.S. Pat. No. 3,328,827 describes a hand-held, air-operated vacuum cleaner for use around gasoline stations that are equipped with high pressure air hoses for use in inflating automobile tires. Such a high pressure air hose is connected to this Lake vacuum cleaner, and the air pressure drives an air turbine that in turn drives a suction fan. The air turbine and the suction fan are both mounted on a common shaft. This vacuum cleaner has a suction head having outwardly disposed forced air discharge ports and a central suction passage.

The Hilbig U.S. Pat. No. 3,678,534 describes a vacuum system for cleaning some surfaces having insoluble dirt particles or coatings firmly attached thereto or embedded therein. One such surface is an acoustical panel having a honeycomb core covered on one side with a thin, imperforate facing sheet and on the other side by a similar facing sheet having a multiplicity of small perforations. The vacuum cleaner head has a high pressure air line with jets of air moving at supersonic speeds. The jet streams dislodge stubborn dirt particles for removal by a vacuum line communicating with the cleaner head.

The Mac Farland U.S. Pat. No. 3,825,972 describes a shag rug rake attachment for mounting on the cleaning nozzle of a vacuum cleaner for combing deep pile shag rugs.

The Haldeman U.S. Pat. No. 3,963,515 describes a conventional vacuum cleaner suction nozzle typically used for cleaning streets or carpets with a plurality of vortex generating air nozzles supported from the nozzle and directed downward ahead of the suction nozzle.

The Rose et al. U.S. Pat. No. 4,037,290 describes an institutional or commercial vacuum cleaner having a downwardly facing hood to form a travelling chamber. An air jet nozzle is positioned within the hood, and the nozzle is moved in a circular horizontal orbit by a variable speed motor. A pump is attached to the hood to maintain a vacuum therein.

OBJECTS OF THE PRESENT INVENTION

A principal object of the present invention is to provide a vacuum cleaning machine with a floor-mounted vacuum hood or travelling vacuum chamber having an optimum combination of suction nozzle intake means in conjunction with jet stream manifold means to augment the suction, as well as soil agitator means positioned between the jet stream means and the suction nozzle means.

A further object of the present invention is to provide a vacuum cleaner machine having within its suction head or hood a means for agitating the soil on the surface to be cleaned in conjunction with compressed air jet stream means to pick up the fluid-borne soil and convey it out through the suction line.

A further object of the present invention is to provide a vacuum cleaner machine of the class described wherein the soil agitating means may be a carpet rake or a fixed, rotating or oscillating brush or roller.

A further object of the present invention is to provide a vacuum cleaner machine of the class described wherein the compressed air jet stream means may be combined within the tines of a flexible rake.

A further object of the present invention is to provide a vacuum cleaner machine of the class described wherein a combined rake and jet stream attachment is combined with a power-driven brush or roller.

Still another object of this invention is to provide a vacuum cleaner machine of the class described wherein the compressed air jet stream are first directed toward or through the flexible rake or brush and then into the intake of a suction line so as to create a streamline path of air flow for gathering up the soil.

SUMMARY OF THE INVENTION

The present invention provides a vacuum cleaning machine having a vacuum hood that is furnished with suction nozzle intake means having an outlet connected to a vacuum source in conjunction with jet stream manifold means that has an inlet connected to a compressed fluid source, and soil agitator means interposed between the jet stream means and the suction nozzle means whereby the jet streams pick up the soil in the vicinity of the soil agitator means and feed in into the suction nozzle means.

BRIEF DESCRIPTION OF THE DRAWINGS

This invention will be better understood from the following description taken in conjunction with the accompanying drawings and its scope will be pointed out in the appended claims.

FIG. 4 is a cross-sectional side elevational view similar to FIG. 3 of a second modification of the present invention having a motor-driven brush or roller, with a combined rake and a source of jet streams fitted down over the brush, where the jet streams are directed toward the working area of the brush.

FIG. 5 is a fragmentary perspective view of the inverted U-shaped shroud of FIG. 4, on an enlarged scale, which serves as a combined rake and a source of jet streams.

DESCRIPTION OF THE PREFERRED EMBODIMENTS

Figure 1:
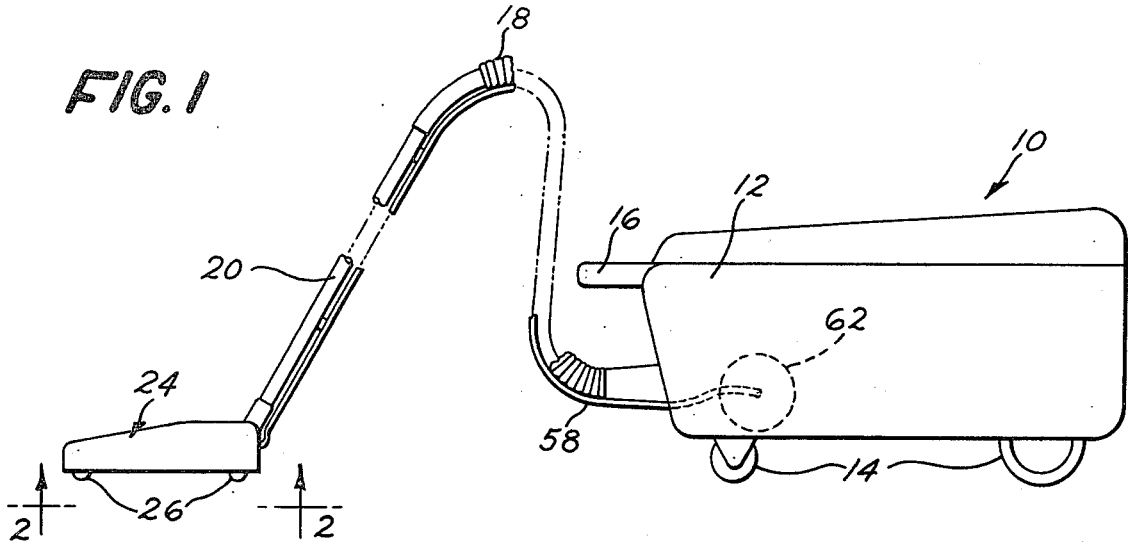
FIG. 1 is a side elevational view of a tank-type vacuum cleaning machine having a floor attachment or suction hood embodying the present invention.

Turning now to a consideration of the drawings and, in particular, to the side elevational view of FIG. 1 there is shown a tank-type vacuum cleaning machine 10 having the floor mounted canister 12 which embodies the usual vacuum motor/blower unit, a renewable filter bag, an electric power cord reel, and manually settable control means for operating the machine. These standard vacuum cleaner elements of a canister machine are not illustrated, as they do not form part of the present invention. What is shown are the support wheels 14, and a front handle 16, for ease in carrying the canister from one place to another. Removably attached to the front of the canister is a flexible, vacuum hose 18 of about 10 feet in length. This hose is adapted to be joined with a slip fit to a metal wand 20, which in turn is fitted into a floor attachment or suction hood 24. It is within this hood 24 that the present invention is employed.

Figure 2:
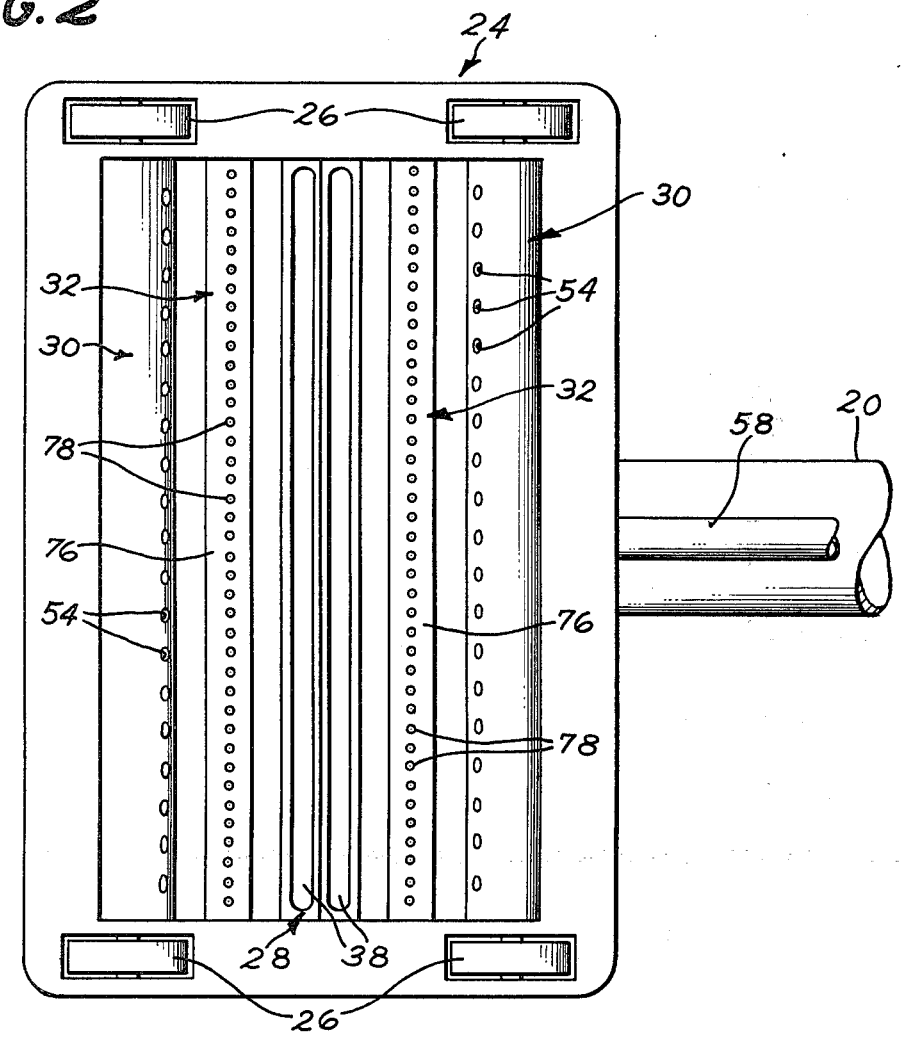
FIG. 2 is a bottom plan view on an enlarged scale of the floor attachment or suction hood of FIG. 1, taken on the line 2—2 of FIG. 1.
Figure 3:
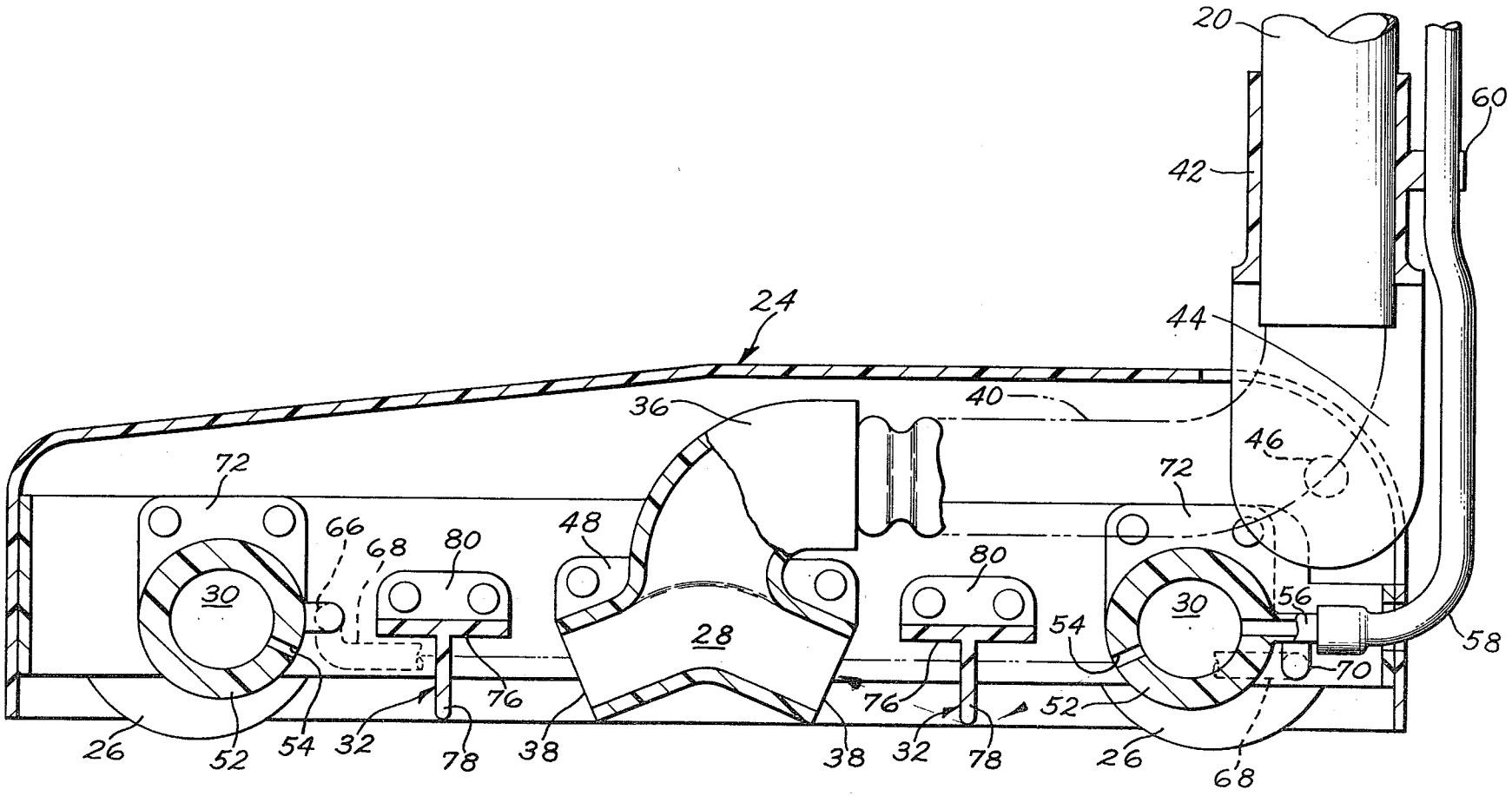
FIG. 3 is a cross-sectional side elevational view on an enlarged scale of the floor attachment or suction hood of FIGS. 1 and 2.

FIG. 2 shows the underside of the suction hood 24, and FIG. 3 shows the suction hood in cross-sectional side elevational view, taken generally through the center of the hood. The hood 24 is a hollow housing that is open at the bottom to be exposed to the floor surface that is to be cleaned. The hood is furnished with support wheels 26 for ease in moving the hood during its cleaning operation. Certain of these wheels would be vertically adjustable for adapting the hood to various types of shag or sculptured carpets, or other irregular floor surfaces.

The hood 24 employs three main elements; namely, a suction nozzle inlet means 28, a jet stream manifold means 30 and a mechanical soil agitator means 32. As illustrated in the modification of FIG. 3, this invention is arranged in duplicate with a dual suction nozzle inlet means 28, a pair of jet stream manifold means 30 as well as a pair of mechanical soil agitator means 32. In other words, it is a symmetrical layout, although it should be understood by those skilled in this art that the invention is fully satisfactory and operational as a single combination of suction nozzle inlet means, jet stream means and soil agitator means.

As can best be appreciated from the underside view of FIG. 2, each side means 28, 30 and 32 is an elongated member that extends from nearly one side of the hood housing to the other side to cover a wide swath as the hood is moved over the surface to be cleaned.

The suction nozzle inlet means 28 is shown in FIG. 3 as an inverted Y-shaped conduit having a short curved elbow 36 at the top, and a pair of oppositely directed intake openings 38, 38. It is these intake openings 38, 38 which are elongated to extend completely across the hood. The elbow 36 is fitted with a short length of flexible hose 40 that cooperates with a vertically hinged adapter 42 that receives with a slip fit the lower end of the metal wand 20. This adapter 42 is provided with a pair of spaced arms 44, 44, each arm having a horizontal trunnion pin 46 for pivotal action within the housing. Mounting bracket 48 may be used at each end to fasten the vacuum suction means 28 within the hood.

Cooperating with each intake opening 38 is a jet stream manifold means 30 which furnishes a plurality of high velocity streams of a fluid to blast or hammer the soil loose from the carpet or other surface that is to be cleaned. For a carpet, the fluid would preferably be compressed air, but for hard surfaces such as tile or concrete pavement the fluid may be water or a suitable cleaning solution. The jet stream manifold means 30 comprises a tubular conduit 52 which is furnished with a plurality of orifices 54 which are all directed down at an inclined angle toward the lower tip of the mechanical soil agitator means 32. The conduit 52 is furnished with a nipple 56 for receiving a compressed air hose 58. This air hose 58 extends out of the back end of the floor attachment or suction hood 24, and is attached by suitable clips 60 to the hinged adapter 42 as well as to the wand 20 and the vacuum hose 18 so as to parallel these elements and not cause an obstruction. Shown in phantom lines in FIG. 1 is a small air compressor 62, which could be powered by the same electric motor of the canister 12, or it could be provided with a separate motor having a turbocharger. Another alternative would be to employ a cylinder or bottle of compressed air or other gases. The jet streams could be made continuous or they could be made to pulsate, or they could be made adjustable somewhere between continuous and variable pulsating. The preferred embodiment of the present invention would employ a pulsating source of compressed fluid. The pressure of the compressed air could be as much as 200 p.s.i. depending upon the number and sizes of the orifices 54, and whether the jet stream was continuous or a pulsating air flow. 30–40 p.s.i. probably would be the preferred air pressure. The total volume of air flow should equate with the volume of air capable of being handled by the vacuum motor/-blower unit.

As mentioned previously, the modification of FIG. 3 is a dual, symmetrical design with a pair of suction nozzle inlet means 28, a pair of jet stream manifold means 30 and a pair of mechanical soil agitator means 32. The frontmost tubular conduit 52 also has a nipple 66 for receiving a compressed air hose 68, and this hose is connected at its other end by an adapter 70 to the source of compressed air hose 58. Again a mounting bracket 72 may be used at each end of the conduit 52 for supporting the conduit in the hood 24.

The third important element of this invention is the mechanical soil agitator means 32, which in FIGS. 2 and 3 is shown as a carpet rake or comb 76, which has a plurality of flexible tines or teeth 78, as is best seen in FIG. 2. If the surface to be cleaned is a shag carpet having a thick nap, the dust, dirt and other foreign particles would be deeply embedded at the base of the strands. Such carpets have gained increased popularity because of their unusual appearance, texture and durability. However, such carpets are the most difficult to clean with a conventional vacuum cleaner since the shag strands are merely leveled or folded over by the floor attachment or vacuum hood. Such leveling tends to cover over the dirt at the base of the strands to prevent dirt pick-up by the vacuum.

In the present invention, the carpet rake or comb 76 is a mechanical soil agitator means which tends to straighten up the carpet strands and at the same time shake the carpet strands to dislodge some of the dirt therefrom. Thus, some of the dirt in, on and around the carpet strands tends to become air borne by action of the carpet rake or comb 76 as the floor attachment or vacuum hood 24 is pushed and pulled back and forth over the carpet during the cleaning operation. The tines or teeth 78 are preferably of flexible plastic, rubber or piano wire material so as not to snag on the carpet strands and cause carpet damage. Instead of a plurality of parallel tines or teeth, the rake could be formed of piano wire made in a horizontal zig-zag or corrugated configuration which is embedded along the top edge of the shape into a hard rubber or plastic mass. It is well that the rake not be so thick or dense that it creates an obstruction or back pressure against the action of the jet streams.

Thus, it will be appreciated by those skilled in this art, that the carpet rake 76 disturbs or shakes the carpet strands and loosens the soil therefrom, as well as opening the pores of the carpet to the joint and complementary action of both the suction nozzle inlet means 28 and the jet stream manifold means 30. Particular attention should be given to FIG. 3 and to the fact that the jet streams from the orifices 54 are directed down at an inclined angle toward the lower tip or working area of the carpet rake or comb 76 and from there the jet streams are deflected by the floor or carpet up into the intake openings 38. Hence, the area in the vicinity of the carpet rake 76 is a very turbulent area that is acted upon by the back and forth mechanical raking action of the rake 76 as well as the simultaneous vacuum action at the intake openings 38 and the jet streams of high velocity compressed air to obtain an optimum cleaning action. The jet streams do an excellent job of dislodging the soil from the interstices of the carpet, and once the soil is air borne it is an easy task to direct the compressed air flow into the suction nozzle means 28 and into the canister for disposal. A mounting bracket 80 at each end of the carpet rake 76 may be used for supporting the rake within the floor attachment or hood 24.

A second modification of the present invention is illustrated in FIGS. 4 and 5. There is shown a compact floor attachment or vacuum hood 84 that has a set of vertically adjustable support wheels 86 and a vertically hinged adapter 88 for receiving the metal wand 20 and accommodating the compressed air hose 58.

This second modification is distinctive in that it employs a power-driven brush or roller 90 as is used today in many conventional upright vacuum cleaners as well as in power operated floor attachments or vacuum hoods. The brush 90 is provided with a belt-drive 92 from a drive motor 94. As is conventional, the brush 90 has a spiral brush element 96 and a spiral beater bar 98 for sweeping up the dirt and directing it toward the suction intake.

This second modification does incorporate the three main elements of the present invention; namely, a suction nozzle inlet means 102, a jet stream manifold means 104 and a mechanical soil agitator means, in the form of the rotating brush 90, which was described above. A short flexible hose 100 joins the suction nozzle means 102 to the hinged adapter 88. This suction nozzle inlet means 102 could be elongated sidewise of the vacuum hood 84 for maximum intake. For optimum results, the jet stream manifold means 104 is formed as an inverted U-shaped shroud 106 that slips down around the brush 90 and is supported in place within the vacuum hood 84 by means of end walls 108 having mounting fastener openings 110. Each end wall has an enlarged opening 112 for accommodating the mounting shaft (not shown) of the rotating brush 90 therethrough.

The inverted U-shaped shroud 106 has hollow walls 114 to accommodate the passage of compressed air therethrough. The top of the shroud is furnished with a nipple 116 for receiving the end of the compressed air hose 58 therewith. The lower edges of the opposite side walls of the shroud are provided with a carpet rake formation 118 having a series of widely spaced hollow tines or teeth 120. An orifice 122 is formed in the side of each tine or tooth and it is directed at an inclined angle down toward the working area of the rotating brush 90, as well as being angled inwardly toward the suction nozzle means 102, as is depicted in FIG. 5. In other words, the jet stream manifold means 104 is a combined carpet rake and source of a plurality of jet streams directed toward the working area of the brush. Thus, the brush 90 stirs up a whirlwind of dust, and so does the two carpet rake formations 118 as the hood is pushed and pulled back and forth, as well as the plurality of jet streams of compressed air from the orifices 122, and it is this powerful whirlwind that is eventually sucked into the suction nozzle means 102 for discharge into the canister 12. Another modification is to eliminate the orifices 122 in the teeth 120 on the side of the rake nearest the suction nozzle means 102 to increase the suction force.

Another modification is to simplify the shroud 106 by leaving off the rake formations 118, 118 and have plain, continuous lower edges of the shroud with the orifices 122 formed on the innermost surfaces of the shroud.

A suitable opening 124 is formed in one side wall of the shroud 106 in the vicinity of the intake opening in the suction nozzle means so as not to interfere with the free movement of exhaust air from within the shroud to the suction nozzle means.

It should be recognized by those skilled in this art that while we have shown this invention incorporated in a floor attachment or vacuum hood, it could just as well be incorporated in an upright vacuum cleaner, a commercial industrial, or a self-propelled street cleaning vacuum machine. Moreover, attachments could be devised using this invention to clean drapes, furniture, machine tools and the like. This use of compressed air tends to apply a lifting force on the floor attachment or hood 24 and 84 so as to increase the ease of pushing and pullng the hood over the floor. Also the use of the compressed air tends to cool the suction motor as well as the brush motor 94 so as to improve the useful life of these motors.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. Vacuum cleaning apparatus including a first source of vacuum air pressure and a second source of compressed air, said apparatus comprising:

a. a vacuum hood enclosure supported on and moveable along a surface to be cleaned and having an open side confronting the said surface to be cleaned to form therewith a traveling vacuum chamber;

b. a suction nozzle inlet opening located within the vacuum hood enclosure and having an outlet opening that is connected to the vacuum air pressure source;

c. a jet stream manifold also located within the vacuum hood enclosure and having an inlet opening that is connected to the compressed air source;

d. an elongated carpet rake having a plurality of teeth that are adapted to comb a carpet, said rake being interposed generally between the jet stream manifold and the suction nozzle inlet opening, and th; jet streams are generally directed toward the lower tips of the teeth and from there toward the intake of the suction nozzle inlet opening;

e. the said suction nozzle intake opening being a double-acting Y-shaped nozzle having a pair of intake openings, there being a pair of carpet rakes, where each rake is interposed near one of the intake openings, and the jet stream manifold is a pair of perforated conduits, each conduit generally paralleling an adjacent rake on the side of the rake that is opposite the intake opening.

2. The invention as recited in claim 1, wherein the said double-acting Y-shaped suction nozzle intake means is an elongated member that is generally the length of both the carpet rakes and of the pair of perforated conduits.

3. Vacuum cleaning apparatus including a first source of vacuum air pressure and a second source of compressed air, said apparatus comprising:

a. a vacuum hood enclosure supported on and movable along a surface to be cleaned and having an open side confronting the said surface to be cleaned to form therewith a traveling vacuum chamber;

b. a suction nozzle inlet opening located within the vacuum hood enclosure and having an outlet opening that is connected to the vacuum air pressure source;

c. a jet stream manifold also located within the vacuum hood enclosure and having an inlet opening that is connected to the compressed air source;

d. a power-driven brush also located within the hood enclosure and within the said open side thereof and being interposed generally between the jet stream manifold and the suction nozzle inlet opening;

e. the said jet stream manifold being in the form of a shroud which overlies the brush, at least one lower edge of the shroud being provided with carpet rake formations, the walls of the shroud having hollow passages for the movement of compressed air therethrough, the lower tips of the rake formation being provided with orifices that are directed toward the working area of the brush, whereby the jet stream manifold is a combined carpet rake and source and carrier of a plurality of jet streams.

4. The invention of claim 3 wherein the said jet strem manifold is in the form of an inverted U-shaped shroud which fits over the, the walls of the shroud having hollow passages for the movement of compressed fluid therethrough, the lower edges of the shroud being provided with orifices that are directed toward the working area of the brush means.

5. The invention of claim 3 wherein the said jet steam manifold is in the form of an inverted U-shaped shroud which is fitted down over the brush means, the lower edges of the shroud being provided with a plurality of jet stream orifices that are aimed toward the working area of the brush.

6. The invention as recited in any of claims 1,2–5, wherein the said jet stream manifold is furnished with a pulsating compressed air to create a hammering action on the soil being dislodged.

* * * * *